United States Patent [19]

Tenquist

[11] 4,065,884

[45] Jan. 3, 1978

[54] WINDOW DRIP COLLECTOR

[75] Inventor: David A. Tenquist, Edina, Minn.

[73] Assignee: Novus Inc., Minneapolis, Minn.

[21] Appl. No.: 729,835

[22] Filed: Oct. 4, 1976

[51] Int. Cl.[2] ..... E06B 7/12

[52] U.S. Cl. ..... 52/37; 52/171

[58] Field of Search ..... 52/37, 171, 172, 202, 52/203, 27

[56] References Cited

U.S. PATENT DOCUMENTS

| | | | |
|---|---|---|---|
| 2,597,097 | 5/1952 | Haven | 52/172 |
| 3,280,523 | 10/1966 | Stroud et al. | 52/172 |
| 3,685,239 | 8/1972 | McCurdy et al. | 52/172 |
| 3,762,118 | 10/1973 | Sanders | 52/171 |
| 3,771,276 | 11/1973 | Stewart et al. | 52/172 |
| 3,900,044 | 8/1975 | Seidman | 52/171 X |
| 3,928,953 | 12/1975 | Mazzoni | 52/172 |

*Primary Examiner*—J. Karl Bell

*Attorney, Agent, or Firm*—Dugger, Johnson & Westman

[57] ABSTRACT

An apparatus for collecting and causing evaporation of water that condenses on the interior surfaces of a window, to inhibit water damage to the window sill and lower portions of the frame. The apparatus includes a member comprising an outer housing that has apertures therethrough that is substantially filled with a foam or other absorbent material. The apparatus is applied to the window generally horizontally across the bottom portion, so that any water that runs down the surface of the window will collect on the device, and will evaporate.

8 Claims, 4 Drawing Figures

FIG. 1
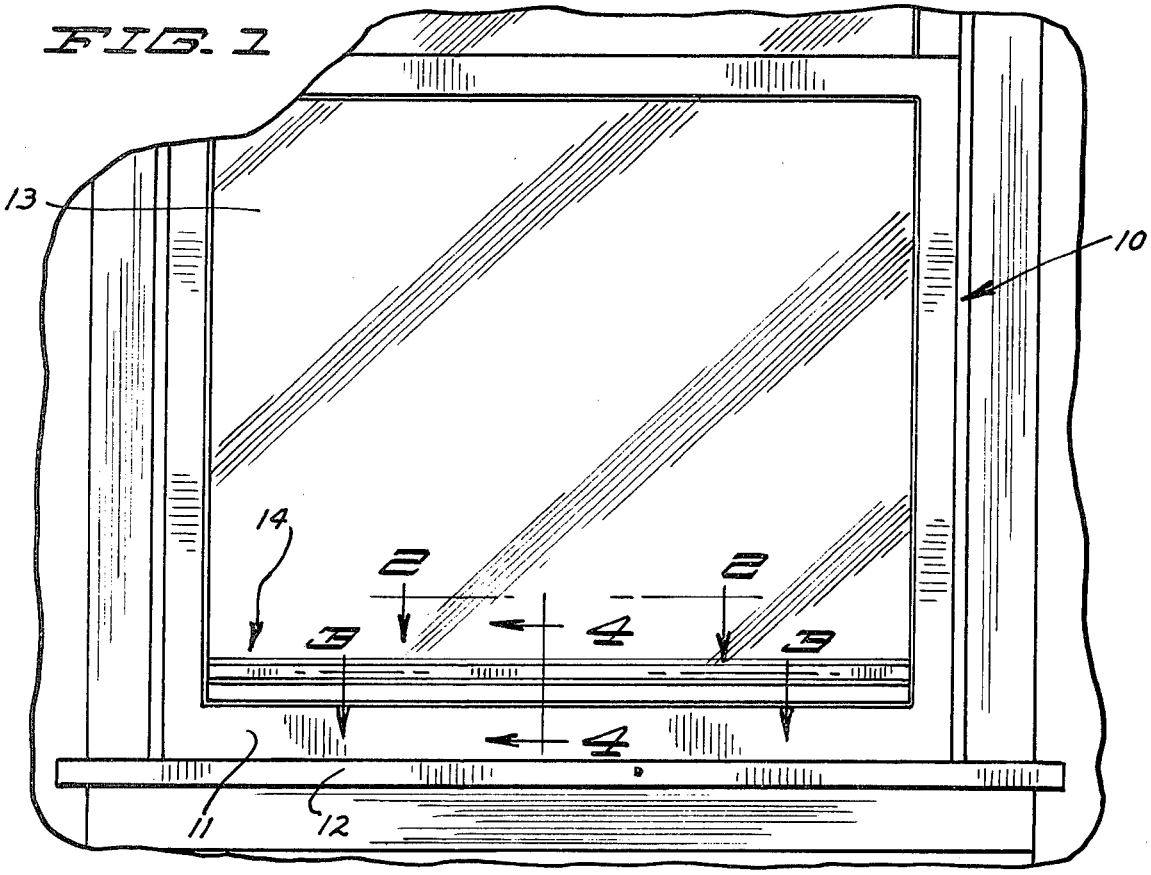
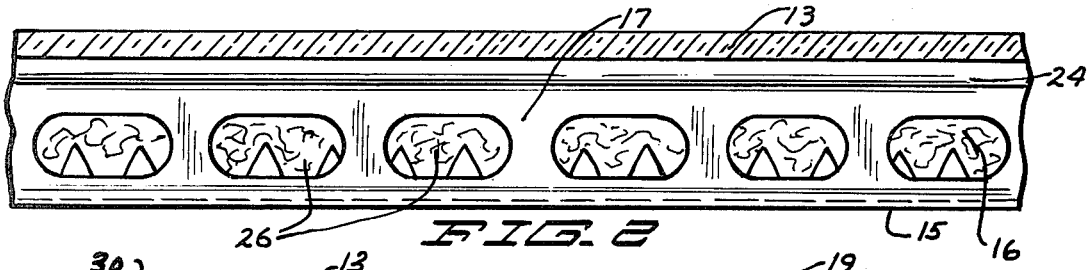
FIG. 2
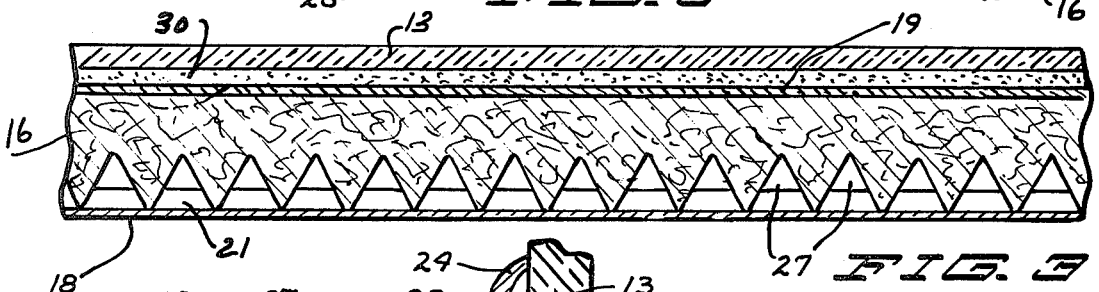
FIG. 3
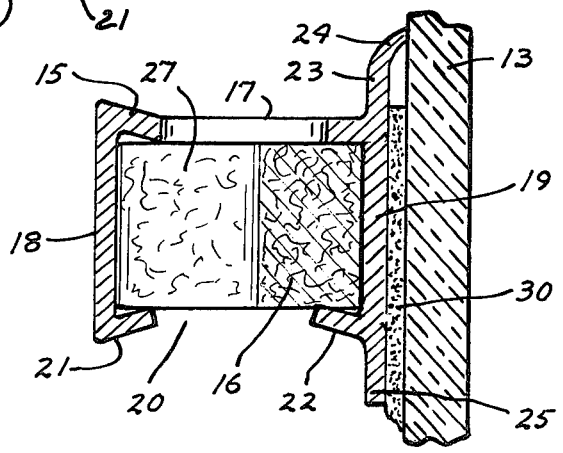
FIG. 4

WINDOW DRIP COLLECTOR

BACKGROUND OF THE INVENTION

1. Field of the Invention

The present invention relates to moisture collectors in an elongated form used primarily on the lower portions of windows for collecting and evaporating condensate.

2. Prior Art

In the prior art, various absorbent devices have been used on items such as toilet tanks, or bottles, such as that shown in U.S. Pat. No. 1,449,365. A housing for a foam member is shown in U.S. Pat. No. 3,018,040. This latest patent includes an insert that absorbs liquids in a saucer.

The applicant is also aware of a prior art moisture collector which was prepared for market more than one year before the filing date of this application by the applicant's assignee. The device comprised a strip of water absorbing foam material with an adhesive back. The foam material, without any cover or shell, was applied directly to the lower portions of the window and extended across the window. Problems evolved from this construction in that the strips were difficult to make and an adhesive that was sufficiently water resistant and could be applied easily by a home owner was not found.

SUMMARY OF THE INVENTION

The present invention relates to a collector for condensation (water) at the lower portions of windows or the like which includes a foam member that will absorb the moisture, but further comprises an outer housing that has a number of apertures in the top surface through which moisture can be admitted into the foam member. The housing also has an opening at the bottom so that air can flow through the foam to aid in the evaporation of moisture collected. The foam core is serrated along one edge as shown so that airflow is enhanced, and the surface area for evaporative action is also increased.

The outer housing includes a resilient lip along the top that will seal tightly against the window when the unit is installed in place on the window, and in this way moisture running down the window will be deflected onto the top surfaces of the housing. This lip will also keep moisture away from the adhesive that is used for attaching the housing to the window so that the adhesive will adhere for a substantial period of time, sufficient to perform satisfactorily.

The device is relatively easy to make, in that the outer housing can be a plastic extrusion, cut to length to suit the home owner, and the interior foam core can easily be manufactured as well and inserted quite quickly into the extrusion. The device can be sold in standard lengths, and then cut with a scissors or other implement by the home owner to fit the existing windows in the house.

The condensation problem is especially prevalent in the northern portions of the country where, in cold weather, frost and ice will build up on the window, and then when the sun comes up and shines through the window and warms the air around it, moisture will run down the window in substantial quantities to cause a problem. Further, if several days of cold weather are encountered where the ice does not melt completely each day, the ice will build up, and then when it does melt it will amount to a substantial amount of water.

The present device will control the flow of water, and will provide for substantial evaporation of water when the ice does melt so that the flow of water down the window will be arrested and controlled before it contacts the frame or the window sill.

BRIEF DESCRIPTION OF THE DRAWINGS

FIG. 1 is a front view of the interior of a typical home window having a collector made according to the present invention installed thereon;

FIG. 2 is a sectional view taken as on line 2—2 in FIG. 1;

FIG. 3 is a sectional view taken as on line 3—3 in FIG. 1; and

FIG. 4 is a sectional view taken as on line 4—4 in FIG. 1.

DESCRIPTION OF THE PREFERRED EMBODIMENT

FIG. 1, in a window indicated generally at 10 includes a frame member 11, a sill 12 at the lower portion thereof, and a glass pane 13 mounted in the frame member. In the northern portions of the country, the panes of glass will be in many instances covered with condensation after a cold night, particularly if the humidity in the room is high, and frost and moisture can build up on the windows to a substantial degree. If frost or ice builds up, when this ice or frost melts, water will run down to the lower portions of the window and contact the wooden window frame, or even cause the sill 12 to become wet. Most varnishes and finishes in homes are not substantially water-resistant, and the water will cause the finish to be ruinied, and in some cases cause the wood to rot.

In order to avoid such problems, a collector for moisture indicated generally at 14 is installed on the window pane 13. The collector 14 in the form shown, and as perhaps can best be seen in FIG. 4, includes an elongated extruded vinyl (plastic) housing 15, and a foam core or filling member 16. The vinyl housing includes a top wall 17, an outer wall 18, which is substantially vertical and faces toward the room. A rear wall 19, which can have apertures therethrough if desired, is also provided. The rear wall would be generally substantially continuous along the length of the housing. At the lower side of the housing an elongated slot 20 is provided, that is defined by a pair of bent lips 21 and 22. The lip 21 extends inwardly from the wall 18, and the lip 22 extends inwardly from the rear wall 19.

The rear wall 19, as shown, has an upper portion 23 that has a bent over flexible lip 24 that engages the window pane 13, with some resilient force when the unit is installed. The rear wall also has a lower stabilizing portion 25 for providing an adequate attaching area.

The top wall 17, as shown, has apertures 26 therethrough, which are spaced along the length, and which provide a substantial amount of open area so that the top wall is open to the foam core 16. Also, as can be seen, the edge of the foam core has a plurality of vertically extending notches 27 therein, to form a serrated or tooth-like edge. These notches are sufficiently deep so that the inner ends will protrude into the apertures 26, as perhaps is best seen in FIG. 2, and air will be free to circulate up through the slot 20 and through the apertures 26, past the vertical surfaces of these notches 27.

The outer housing, and the foam core insert are held against the inner surface of the glass pane 13 through the use of a suitable adhesive strip 30, which will adequately hold the housing and the foam strip to the window pane under normal circumstances. The upper edge of the lip 24 engages the window pane with some resilient force to provide a seal so that any moisture flowing down the window will flow past this lip and onto the upper wall 17. Most of the water will not contact the adhesive strip 30.

Then, water will pass into the foam through the apertures 26, and be absorbed by the foam (or other suitable absorbent material) during the times of rapid melting or flow of the condensation. Subsequent to this time, and also during the time of melting, air will flow up by natural convection through the slot 20, past the surfaces of the notches or apertures 27 in the foam core 16, and out through the apertures 26 to provide an evaporative effect to tend to remove the moisture from the foam core. The foam core provides a reservoir for the moisture until such time as the evaporation can take place and remove the moisture. The foam core is made of a sufficient size so that in substantially all instances, it will handle the excess flow of liquid that prevents any water from contacting the lower portion of the window frame, or the window sill.

The foam must be able to absorb water. Most synthetic foams have to be treated with a suitable surfactant to function properly.

It should be noted that the outer housing is a coextrusion using a relatively rigid plastic for the lower portions which hold the foam, and a softer, more resilient plastic for the lip 24. Such dual material extrusions are commonly used in plastic window and door weatherstripping. However with the present extrusion the rigid plastic holds the foam material securely and neatly while the softer lip provides a seal to direct water to the foam member.

The lower wall portion 25 of the housing serves as an automatic spacer to keep the bottom slot spaced above the window frame for air circulation. Also the portion 25 increases the available wall area for the adhesive strip. The adhesive strip may be ordinary double sided tape is desired.

The use of the housing protects the adhesive used so that this will not lose its holding power, and further, the serrations permit adequate airflow for substantial evaporation rates during times of high melting rate for frost or ice on the windows.

What is claimed is:

1. A device for collecting moisture on a vertical pane such as a window pane having an interior surface exposed to the interior atmosphere of a heated room including a housing, means to apply said housing to the window pane on the interior surface of the window pane adjacent the lower edges thereof and substantially horizontal, said housing spanning substantially the entire width of said window, a water absorbent air premeable insert in said housing, said housing having an upper wall having apertures provided therethrough opening to said insert and being exposed to ambient air in said room along the length of said housing, and said housing defining a lower opening to permit ambient air from the interior of the room to enter the housing.

2. The combination of claim 1 wherein said housing has a sealing lip connected to said upper wall extending upwardly therefrom, said lip engaging a window pane when the housing is attached to said window pane to direct flow from said window pane to said upper wall.

3. The combination specified in claim 1 wherein said insert is a homogeneous member and has a plurality of apertures therethrough forming substantially vertical surfaces to permit airflow through said apertures in the insert from the lower opening through the openings in the upper wall.

4. The combination specified in claim 1 and said means to apply said housing to the interior surface of a window pane comprising an adhesive strip attached to said housing and having an adhesive surface to contact said window pane.

5. The combination specified in claim 1 wherein said housing includes a vertical outside wall that is substantially continuous, said vertical outside wall having a lip bent over and extending inwardly to form a portion of a bottom wall, a second lip bent over from said rear wall of said housing, said first and second lips of said housing being spaced apart to define said lower opening as a generally continuous opening along the bottom edge of said housing.

6. A collector for collecting moisture condensation from a surface of a window exposed to ambient air comprising an elongated housing having aperture means in the upper and lower sides thereof, a liquid absorbing foam core having a plurality of openings forming generally vertical surfaces therethrough which align with the aperture means to permit convective airflow through said aperture means and said openings, and means to attach said housing to an exposed surface of a window with the elongated housing extending generally horizontally and spanning substantially the entire width of the window on which it is mounted, said housing being exposed to ambient air on at least the top and bottom thereof along substantially its entire length.

7. The collector of claim 6 wherein said openings comprise V notches formed along one edge of said foam core.

8. The collector of claim 6 wherein said housing includes a wall portion positioned adjacent a window on which the collector is installed having an edge extending below the lower side of said housing to provide spacer means to space adjacent portions of a window from the apertures in said lower side.

* * * * *